United States Patent [19]

Doliwa et al.

[11] 4,412,578

[45] Nov. 1, 1983

[54] APPARATUS FOR TREATING MOLTEN CAST IRON

[75] Inventors: Ernst J. Doliwa, Niddatal; Karl J. Reifferscheid, Karben; Friedrich Wolfsgruber, Teacherting, all of Fed. Rep. of Germany

[73] Assignees: Metallgesellschaft AG, Frankfurt am Main; SKW Trostberg, Trostberg, both of Fed. Rep. of Germany

[21] Appl. No.: 244,955

[22] Filed: Mar. 18, 1981

[30] Foreign Application Priority Data

Mar. 20, 1980 [DE] Fed. Rep. of Germany ..... 3010623

[51] Int. Cl.[3] ..... B22D 27/00

[52] U.S. Cl. ..... 164/349; 164/58.1

[58] Field of Search ..... 164/55.1, 56.1, 57.1, 164/58.1, 349

[56] References Cited

FOREIGN PATENT DOCUMENTS

| | | | |
|---|---|---|---|
| 1172806 | 1/1965 | Fed. Rep. of Germany . | |
| 1248239 | 8/1967 | Fed. Rep. of Germany . | |
| 2518367 | 8/1978 | Fed. Rep. of Germany . | |
| 2807048 | 8/1978 | Fed. Rep. of Germany ..... | 164/57.1 |
| 1559584 | 1/1980 | United Kingdom ..... | 164/58.1 |
| 622557 | 5/1978 | U.S.S.R. ..... | 164/55.1 |

*Primary Examiner*—Kuang Y. Lin

*Attorney, Agent, or Firm*—Karl F. Ross; Herbert Dubno

[57] ABSTRACT

It is known to contact molten cast iron with various treating agents in the casting mold in order to influence the base structure or the form of the graphite. Such casting molds for making castings of cast iron containing vermicular and/or spheroidal graphite are provided with an intermediate chamber, which is provided in the pouring system between the pouring gate and the ingate to the casting mold proper. That intermediate chamber serves to receive the graphitizing agent and to contact it with the molten cast iron. To permit a functional adaptation of the chamber surface area or the surface area of the treating agent contained in the chamber to the pouring gate, which changes as the pouring proceeds, the casting mold is provided with a frustopyramidal intermediate chamber which has a rectangular base disposed in the parting plane of the mold.

1 Claim, 2 Drawing Figures

APPARATUS FOR TREATING MOLTEN CAST IRON

FIELD OF THE INVENTION

Our present invention relates to a casting mold for treating molten metal, particularly molten cast iron used to produce cast iron containing spheroidal and/or vermicular graphite and to a method of casting iron.

BACKGROUND OF THE INVENTION

It is known to contact molten cast iron in the casting mold with various treating agents in order to influence the basic structure or the shape of the graphite.

Such treatments rely on the fact that the treatment will be the more effective the shorter is the time between the addition of the treating agent and the solidification of the molten material (German patent publication No. 12 48 239; German Pat. No. 1,172,806).

German patent publication No. 25 18 367 discloses another process, which serves to make modular iron and in which a casting mold provided with an intermediate chamber is used. In that process it is essential that the surface of the graphite-spheroidizing agent contained in the intermediate chamber has always the same area. For this reason it is believed that the base area of the intermediate chamber used in said process is a decisive feature and that other dimensions of the chamber are not significant.

The use of the known reaction chamber has given satisfactory results and permits a favorable utilization of the treating agent. But that process too does not comply in all cases with the conditions encountered in foundry practice.

OBJECTS OF THE INVENTION

It is an object of the invention to ensure a uniform treatment of the molten metal flowing into the casting mold and to avoid a surplus of the treating agent.

Another object of the invention is to provide an improved method of iron casting which promotes the formation of uniform cast-iron bodies containing spheroidal (globular) and/or vermicular graphite.

It is also an object of the invention to provide an improved casting mold, especially a two-part casting mold having a cope and a drag, whereby problems with earlier systems are avoided.

SUMMARY OF THE INVENTION

These objects are accomplished according to the invention by the provision of a casting mold for making castings consisting of cast iron containing vermicular and/or spheroidal graphite, comprising an intermediate chamber, which is provided in the pouring system between the pouring gate and the in gate to the casting mold proper and serves to receive the graphitizer and to contact it with the molten cast iron. In accordance with the invention, such casting mold is characterized in that the intermediate chamber is frustopyramidal and has a rectangular base disposed in the parting plane of the mold.

The molten cast iron flowing into the casting mold contacts the treating agent and thus initiates a reaction. It has also been found that the use of a pouring system which contains the treating agent results in a longer pouring time than the use of a pouring system which contains no treating agent.

The increase of the pouring time is due to the fact that the molten iron reacting with the treating agent presents a higher resistance to the flow of the molten iron which is following up. Besides, there will be a backpressure when the mold has been filled above its parting plane. As the increase of the pouring time involves a longer residence time in the chamber, the surface area presented by the treating agent must be decreased as the pouring time increases if a uniform treatment of the molten metal is to be ensured, e.g. a uniform treatment of the molten cast iron with magnesium or a magnesium-containing alloy.

In accordance with the invention the reaction chamber in the casting mold consists of an inverted frustum of a pyramid which has a base disposed in the parting plane of the mold. The base is rectangular and particularly square. The height of the frustopyramidal chamber is suitably twice to three times the side length of the base. The side faces of the frustopyramidal reaction chamber have an inclination of 50 degrees to up to 80 degrees. With that inclination and that shape it is ensured that the inflowing molten iron will be thrown back at the wall surface opposite to the gate and will thus be forcibly mixed.

Within the scope of the invention the frustopyramidal chamber may be pontoon-shaped. In another embodiment of the invention the outlet from the chamber is at right angles to the inlet to the chamber and the inlet to and the outlet from the chamber are on different levels, i.e., the outlet opening for the molten metal lies above the inlet opening. As a result of these measures, the molten iron which as it is cast always will be treated in the reaction chamber and cannot simply flow into said chamber over the molten iron which is contained in the reaction chamber and is reacting therein with the treating agent.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
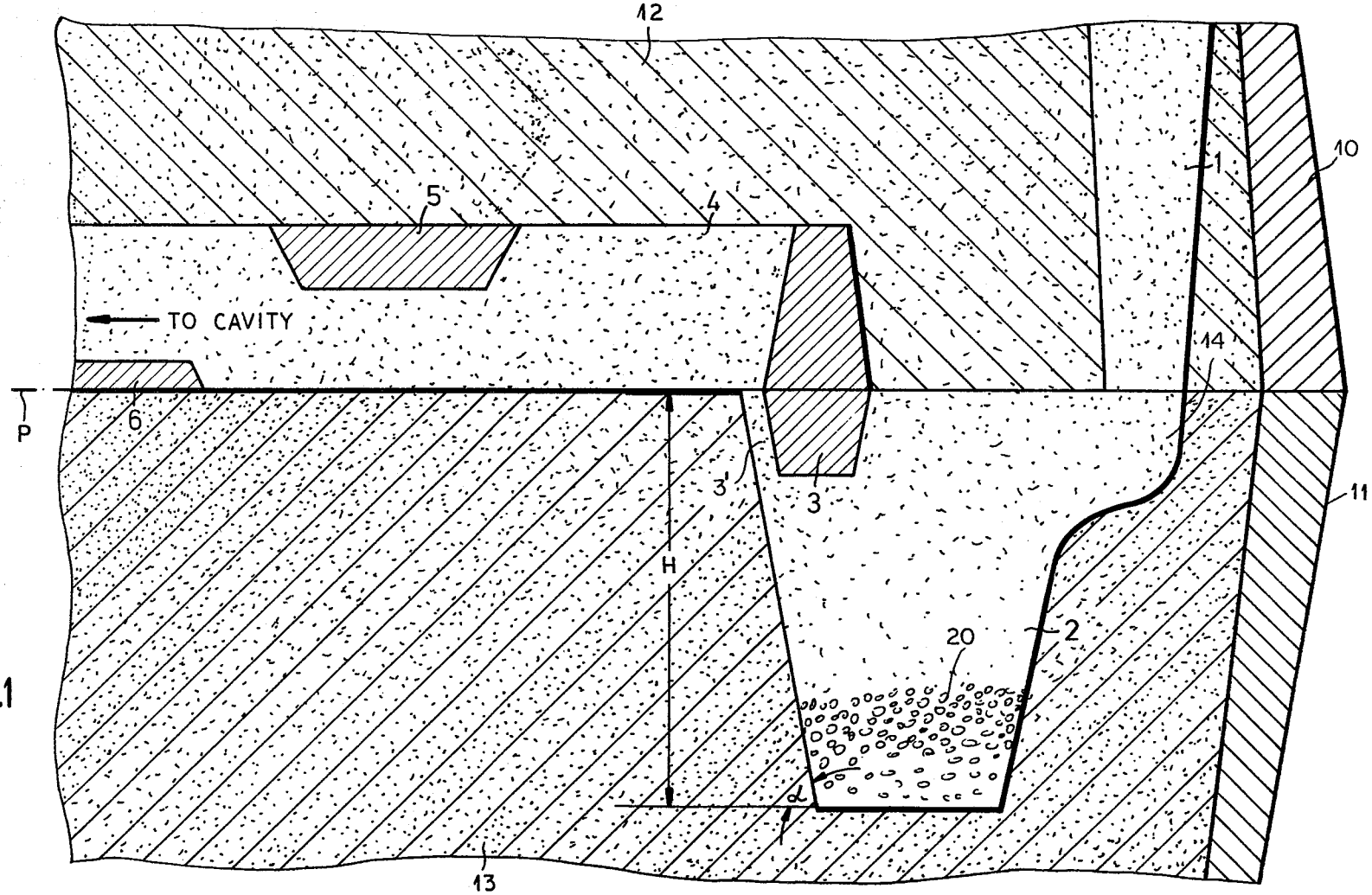
FIG. 1 is a diagrammatic vertical section through a sand-casting mold applying the principles of the present invention.
Figure 2:
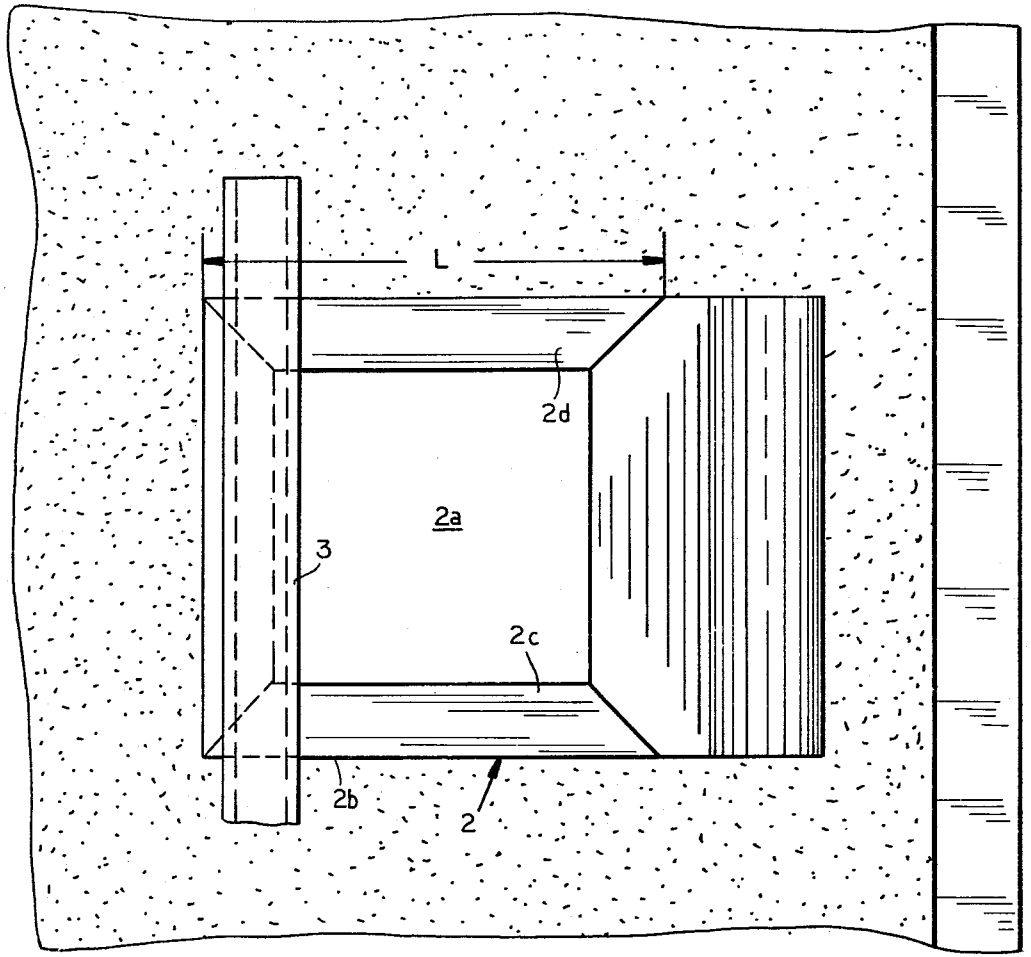
FIG. 2 is a plan view of the lower portion of this mold showing the reaction chamber from above.

As will be apparent from FIGS. 1 and 2, the said mold can have a flask formed by an upper flask portion 10 and a lower flask portion 11 forming the cope and drag sections of the mold and packed with sand 12, 13 to define a parting plane P between the mold parts.

The upper mold part is provided with the issue sprue 1 which opens into a reaction chamber. In the preferred or best mode embodiment of the invention, the reaction chamber may have the configuration of an inverted frustum of a pyramid whose small base 2*a* is turned downwardly and whose broad base 2*b* lies in the plane P. The height H of this chamber is 2 to 3 times the smallest side length L of the broad base in the best mode embodiment of the invention and the angle $\alpha$ at which the sides of the pyramid are inclined to the horizontal can range between 50° and 80°.

While the rectangular plan configuration of the base is preferably a square configuration, it should be noted that the opposite sides 2*d* and 2*c* can be oppositely concave thereby imparting a pontoon shape to the cross section or plan configuration or can be shorter sides of the rectangle.

In the embodiment of FIGS. 1 and 2 the bar 3 defining the outlet gate 3' ensures that this outlet gate will commence at a location below the inlet gate 14. Either of these arrangements will ensure that molten metal cannot pass directly from inlet side to outlet side without engaging in a complex flow pattern thereby guaranteeing intimate mixing of the molten metal with the treatment agent shown at 20 in FIG. 1.

In the embodiment, the treated molten metal passes from the reaction chamber to a runner 4 formed in the upper flask, past a slag snubber 5 and across a bar 6 to the in-gates of the mold cavities not shown.

The casting mold is used to treat molten metal, particularly to make castings of cast iron containing vermicular and/or spheroidal graphite. The graphitizing agent (all percents by weight) introduced into the frustopyramidal reaction chamber may consist of lumps or agglomerates or a powder or of a body cast from molten material, e.g. in the form of a sphere, cylinder or frustum of a cone. Such agents for treating molten cast iron are known and may consist, e.g., of magnesium or magnesium-containing alloys. Nodular iron may be made, e.g. with the aid of a magnesium-containing alloy composed of 3 to 15% by weight magnesium,
40 to 70% by weight iron,
optionally 0.3 to 2.5% by weight calcium,
optionally 0.3 to 2.0% by weight rare earth metals, with the cerium content amounting to 50% by weight, the lanthanum content amounting to 20 to 30% by weight, balance other rare earth metals, balance silicon.

In the use of an alloy of this type, which contains rare earth metals, it has been found to be desirable to entirely or partly replace the cerium-containing misch metal, which is conventionally used in alloying, by lanthanum. In such case the content of other rare earth metals in the lanthanum must be less than 20% by weight. In accordance therewith a master alloy which contains rare earth metals preferably contains 0.2 to 1.0% by weight lanthanum.

An alloy composed of
3.0 to 4.0% magnesium
3.5 to 4.5% rare earth metals
4.0 to 5.5% titanium
0.1 to 1.0% calcium
45.0 to 55.0% silicon
balance—iron is particularly suitable for making cast iron containing vermicular graphite.

In the treatment of molten cast iron, the use of the present invention results in various advantages. Graphite can be completely converted to spheroidal or vermicular graphite because the molten material is treated with the treating agent at a uniform rate, and the economical utilization of the treating agent is ensured. There is no need for a surplus of the treating agent.

Owing to the specific geometric configuration of the reaction chamber, the surface area of the chamber becomes functionally adapted to the pouring rate, which varies as the pouring process proceeds. Because the angle of inclination of surfaces defining the reaction chamber can be varied, the pouring rate may be varied within a wider range. Besides, the casting mold according to the invention is less susceptible to variations in the particle size distribution of the alloy and will promote the mixing of the molten material and optimize the yield of the master alloy. Moreover, the casting mold according to the invention affords a maximum reliability regarding the segregation of slag so that the castings will be absolutely free from slag.

SPECIFIC EXAMPLES

EXAMPLE 1

A base iron composed of 3.75% C, 2.10% Si, 0.12% Mn, 0.035% P and 0.010% S, balance Fe, was melted in an induction furnace. A master alloy to be added in an amount of 0.7% by weight of the iron amounting to 60 kilograms was placed into the frustopyramidal intermediate chamber, which had a base surface of 45×45 mm and a chamber volume of 605 $cm^3$. The proportion of master alloy was selected with a view to the sulfur content of the base iron and the pouring temperature of 1450° C. The magnesium-containing master alloy had a particle size 1 to 4 mm and was composed of 6.0% Mg, 0.5% Ca, 45.0% Si, 0.9% cerium-containing misch metal, balance Fe. Pouring into the mold was effected within 17 seconds. The casting had a chemical analysis of 3.7% C, 2.41% Si, 0.12% Mn, 0.035% P, 0.008% S, 0.028% residual magnesium, balance iron. The metallographic examination of the casting in a wall thickness range of 8 to 30 mm revealed a formation of spheroidal graphite amounting to at least 90% spherolites and a presence of 93% ferrite and 7% pearlite as structural constituents. The number of spherolites, amounting to about 300 per $mm^2$ of microsection area, was surprisingly high. The metallographic examination of various portions of the casting revealed that the casting was perfectly free from reaction products and slag inclusions.

EXAMPLE 2

The base iron used in Example 1 was used to cast another casting having a weight of 30.5 kilograms. A magnesium-containing master alloy was used, which had the following analysis: 5.7% Mg, 0.3% Ca, 46.1% Si, 0.5% La, balance Fe. 183 grams of the master alloy, having a particle size range from 0.5 to 3 mm, were contained in the frustopyramidal intermediate chamber which had a base surface of 35×35 mm and a chamber volume of 300 $cm^3$. Pouring into the mold was effected within 11 seconds at a temperature of 1440° C. The final analysis was 3.67% C, 2.35% Si, 0.11% Mn, 0.03% P, 0.006% S, and 0.024% Mg, balance Fe.

The metallographic examination of a lug sample 20 mm in diameter revealed a formation of spheroidal graphite comprising about 95% spherolites in conjunction with structural constituents consisting of 95 to 100% ferrite and 0 to 5% pearlite. No cementite was found in the base structure. There were about 350 spherolites per $mm^2$ of microsection area. The casting was free from inclusions of any kind.

Test rods in accordance with DIN were made from the lug sample and were tested with the following results:

Ultimate tensile stress Rp—457 $N/mm^2$
Yield point Rm—288 $N/mm^2$
Elongation at break $\delta 5$—22.5%
Brinell hardness $HB_{30/2.5}$—182/182

EXAMPLE 3

A base iron composed of 3.52% C, 0.18% Mn, 0.44% P, 1.95% Si and 0.006% S, balance Fe, was melted in an induction furnace. A pontoon-shaped intermediate chamber having a base surface of 25×25 mm and a volume of 250 $cm^3$ was used to make a casting having a weight of 250 $cm^3$. The intermediate chamber contained 130 grams of a master alloy, which had a particle size of 1 to 3 mm and the following analysis:

3.3% Mg, 0.5% Ca, 50.7% Si, 4.0% cerium-containing misch metal, 5.5% Ti, balance Fe. Pouring into the mold was effected within 8 seconds and at a temperature of 1450° C. The final analysis was 3.48% C, 0.38% Mn, 0.044% P, 2.18% Si, 0.06% Ti, 0.004% S, 0.015% Mg, 0.014% Ce, balance Fe.

In all cross-sections of the casting, i.e. 7 to 15 mm, the cast structure was found to contain compact graphite in a predominantly ferritic matrix. About 80% of the graphite were vermicular and about 20% of it were spherolitic. No flaky graphite was found. The casting was free from inclusions.

We claim:

1. A casting mold for making castings of cast iron containing vermicular and spheroidal graphite, comprising:

means forming a runner leading to a mold cavity;

a sprue for feeding metal into said cavity;

a reaction chamber between and below said sprue and said runner for receiving a graphitizer and reacting said graphitizer with a cast iron melt, said reaction chamber being of downwardly convergent cross section and having a wide end lying in a parting plane of the mold, said chamber being of frustopyramidal configuration having:

a broad rectangular base in said parting plane of said mold, a wall extending upwardly at an angle of 50° to 80° to the horizontal, a height which is substantially two to three times the width of one of the bases of said chamber, and at least one of said bases generally of square configuration; and a bar of trapezoidal cross section extending downwardly from said runner into said reaction chamber and having a flank parallel to said wall at an upper end thereof whereby said flank and said wall define an outlet from said reaction chamber into said runner which lies below the inlet from said sprue into said reaction chamber.

* * * * *